US007902766B2

(12) United States Patent
Lee et al.

(10) Patent No.: US 7,902,766 B2
(45) Date of Patent: Mar. 8, 2011

(54) PLASMA LIGHTING SYSTEM

(75) Inventors: Ji-Young Lee, Gyeonggi-Do (KR); Joon-Sik Choi, Seoul (KR)

(73) Assignee: LG Electronics Inc., Seoul (KR)

( * ) Notice: Subject to any disclaimer, the term of this patent is extended or adjusted under 35 U.S.C. 154(b) by 1304 days.

(21) Appl. No.: 11/406,327

(22) Filed: Apr. 19, 2006

(65) Prior Publication Data

US 2006/0250065 A1 Nov. 9, 2006

(30) Foreign Application Priority Data

Apr. 21, 2005 (KR) ..... 10-2005-0033334

(51) Int. Cl.
*H05B 41/16* (2006.01)

(52) U.S. Cl. ..... 315/248; 315/39; 315/39.51; 315/344; 315/111.21; 313/113; 313/116; 313/160

(58) Field of Classification Search ..... 315/248, 315/39, 39.51, 111.21, 111.71, 112, 118, 315/344; 313/113, 153, 116, 160
See application file for complete search history.

(56) References Cited

U.S. PATENT DOCUMENTS

| | | | | |
|---|---|---|---|---|
| 5,334,913 | A | 8/1994 | Ury et al. | |
| 5,811,936 | A * | 9/1998 | Turner et al. | 315/39 |
| 6,774,571 | B2 * | 8/2004 | Choi et al. | 315/112 |
| 7,081,702 | B2 * | 7/2006 | Seo | 313/153 |
| 2002/0030453 | A1 | 3/2002 | Kirkpatrick et al. | |
| 2006/0076902 | A1 | 4/2006 | Kim et al. | |
| 2006/0087256 | A1 | 4/2006 | Park et al. | |

FOREIGN PATENT DOCUMENTS

| | | |
|---|---|---|
| CN | 1350698 | 5/2002 |
| EP | 1494265 | 1/2005 |
| JP | 62-105355 | 5/1987 |
| JP | 2000-353495 | 12/2000 |
| KR | 2002-0054161 | 7/2002 |
| WO | 97/27617 | 7/1997 |
| WO | 03/107725 | 12/2003 |

OTHER PUBLICATIONS

English Language Abstract of JP 2000-353495, dated Dec. 19, 2000.
Chinese Office Action dated Apr. 3, 2009 with translation.

* cited by examiner

*Primary Examiner* — Haissa Philogene
(74) *Attorney, Agent, or Firm* — KED & Associates LLP

(57) ABSTRACT

A plasma lighting system comprises a resonator, a bulb received in the resonator and containing a discharge material therein for emitting light in accordance with the discharge material is exited as a plasma state, and a dielectric mirror disposed at one side of the bulb and formed of a spontaneous reflective material for spontaneously reflecting light generated from the bulb. The dielectric mirror can be included or excluded, and can smoothly reflect light without an additional reflection coating layer. The dielectric mirror is prevented from being damaged even in a high temperature, and thus a lowering of an optical efficiency is prevented when used for a long time.

1 Claim, 6 Drawing Sheets

PLASMA LIGHTING SYSTEM

BACKGROUND OF THE INVENTION

1. Field of the Invention

The present invention relates to a plasma lighting system using electromagnetic wave, and more particularly, to a dielectric mirror for a plasma lighting system.

2. Description of the Background Art

Generally, an optical source for illumination is divided into an incandescent lamp using heat radiation, a fluorescent lamp using a fluorescent body at a discharge pipe, a high intensity discharge lamp (HID lamp) using luminance by a discharge of gas of a high pressure or vapor, and a plasma lighting system using an electrodeless discharge.

The incandescent lamp has a high color rendering, a small size, a simple lighting circuit, and a low price. However, the incandescent lamp has a low optical efficiency and a short life span. The fluorescent lamp has an optical efficiency higher than that of the incandescent lamp and a life span longer than that of the incandescent lamp. However, the fluorescent lamp has a relatively large size and requires an additional lighting circuit. The HID lamp has a high optical efficiency and a long life span. However, the HID lamp requires time in lighting and re-lighting and needs an additional lighting circuit. The PLS lamp has a life span longer than any other lamp and a highest optical efficiency. However, the PLS lamp has a large consumption power and a high price, and requires an additional lighting circuit.

The PLS lamp is recognized as a new optical source. A plasma lighting system using the PLS lamp emits light of a high optical amount without an electrode by making a discharge material inside a bulb into plasma by electromagnetic wave generated from a magnetron of a microwave oven and thereby continuously emitting light by a metal compound.

The bulb of the plasma lighting system contains a main discharge material such as a metal, a halogen-based compound, sulfur, or selenium for emitting light by forming a plasma, an initial discharge material such as Ar, Xe, Kr, etc. for forming plasma inside a light emitting portion at the time of an initial luminance, and a discharge catalyst material such as Hg for facilitating lighting by an initial discharge or controlling a light spectrum.

FIG. 1 is a longitudinal section view showing one example of a plasma lighting system in accordance with the conventional art, and FIG. 2 is a perspective view showing a dielectric mirror in the plasma lighting system in accordance with the conventional art.

As shown, the conventional plasma lighting system comprises a magnetron 20 mounted in a casing 10 and generating electromagnetic wave, a high voltage generator 30 for supplying alternating current (AC) power to the magnetron 20 by boosting into a high voltage, a wave guide 40 connected to an outlet of the magnetron 20 for transmitting electromagnetic wave generated from the magnetron 20, a resonator 50 connected to an outlet of the wave guide 40 for resonating the electromagnetic wave passing through the wave guide 40, a bulb 60 disposed in the resonator 50 for emitting light by making the discharge materials filled therein into plasma by electromagnetic wave, a reflector 70 containing the resonator 50 therein for forwardly reflecting light generated from the bulb 60, a dielectric mirror 80 mounted in the resonator 50 positioned at a rear side of the bulb 60 for passing electromagnetic wave and reflecting light, and an electromagnetic wave guiding plate 90 covering the outlet of the wave guide 40 and having an electromagnetic wave passing hole 91 for connecting the wave guide 40 and the resonator 50 to each other.

The bulb 60 comprises a light emitting portion 61 having an inner volume and a sphere shape formed of a quartz material, disposed outside the casing 10, and having a discharge material, a discharge catalyst material, etc. therein for emitting light by making the inner materials into plasma; and a supporting portion 62 integrally extending from the light emitting portion 61 and supported in the casing 10.

As shown in FIG. 2, the dielectric mirror 80 comprises a glass plate 81 formed of a quartz material so as to be endurable against a high temperature, and a reflection coating layer 82 coated at one side of the glass plate 81 for reflecting light generated from the bulb 60 in a forward direction.

The electromagnetic wave guiding plate 90 is provided with the electromagnetic wave passing hole 91 for guiding electromagnetic wave to the resonator 50 by connecting the wave guide 40 and the resonator 50 to each other at the center thereof. Also, a fixing portion 92 having the electromagnetic wave passing hole 91 for fixing the reflector 70 at an outer circumferential surface thereof and fixing the dielectric mirror 80 thereon is formed at one side of the electromagnetic wave guiding plate 90. The fixing protrusion 92 has a height not to cover the light emitting portion 61 of the bulb 60.

An unexplained reference numeral 11 denotes an air inlet, 12 denotes an air outlet, 13 denotes an air flow path, F denotes a cooling fan, M1 denotes a bulb motor for rotating the bulb, and M2 denotes a fan motor for rotating the cooling fan.

An operation of the conventional plasma lighting system will be explained as follows.

When a driving signal is inputted to the high voltage generator 30 by a controller, the high voltage generator 30 boosts alternating current (AC) power thus to supply it to the magnetron 20. Then, the magnetron 20 is oscillated by the high voltage thus to generate electromagnetic wave having a high frequency. The electromagnetic wave is emitted into the resonator 50 through the wave guide 40, and continuously excites the discharge material and the discharge catalyst material contained in the bulb 60 into a plasma state. As the result, light having a specific emission spectrum is generated, and the light is forwardly reflected by the reflector 70 and the dielectric mirror 80 thus to illuminate a space.

However, the conventional plasma lighting system has the following problem. When the reflection coating layer 82 is formed at the glass plate 81 formed of a quartz material in order to fabricate the dielectric mirror 80, the reflection coating layer 82 is degraded by heat of a high temperature thus to be damaged. As the result, when the reflection coating layer 82 is used for a long time, a reflection efficiency is lowered.

SUMMARY OF THE INVENTION

Therefore, an object of the present invention is to provide a plasma lighting system capable of preventing a reflection efficiency of a dielectric mirror from being lowered.

To achieve these and other advantages and in accordance with the purpose of the present invention, as embodied and broadly described herein, there is provided a plasma lighting system, comprising: a resonator; a bulb received in the resonator and containing a discharge material therein for emitting light by making the discharge material into plasma; and a dielectric mirror disposed at one side of the bulb and formed of a spontaneous reflective material for spontaneously reflecting light generated from the bulb.

According to another aspect of the present invention, there is provided a plasma lighting system comprising: a magnetron; a wave guide connected to the magnetron for guiding electromagnetic wave; a resonator connected to the wave guide for resonating electromagnetic wave; a bulb received in the resonator and containing a discharge material therein for emitting light as the discharge material becomes a plasma state by an electric field; a reflector containing the resonator and the bulb therein for reflecting light generated from the bulb; an electromagnetic wave guiding plate disposed between the wave guide and the resonator and having an electromagnetic wave passing hole to connect the wave guide and the resonator to each other at a surface that covers an outlet of the wave guide; and a dielectric mirror disposed at the electromagnetic wave guiding plate and formed of a spontaneous reflective material for spontaneously reflecting light generated from the bulb.

According to still another aspect of the present invention, there is provided a plasma lighting system comprising: a magnetron; a wave guide connected to the magnetron for guiding electromagnetic wave; a resonator connected to the wave guide for resonating electromagnetic wave; a bulb received in the resonator and containing a discharge material therein for emitting light as the discharge material becomes a plasma state by an electric field; a reflector containing the resonator and the bulb therein for reflecting light generated from the bulb; and an electromagnetic wave guiding plate disposed between the wave guide and the resonator and having an electromagnetic wave passing hole to connect the wave guide and the resonator to each other at a surface that covers an outlet of the wave guide, for reflecting light generated from the bulb.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Reference will now be made in detail to the preferred embodiments of the present invention, examples of which are illustrated in the accompanying drawings.

Hereinafter, a plasma lighting system according to the present invention will be explained in more detail with reference to the attached drawings.

Figure 1:
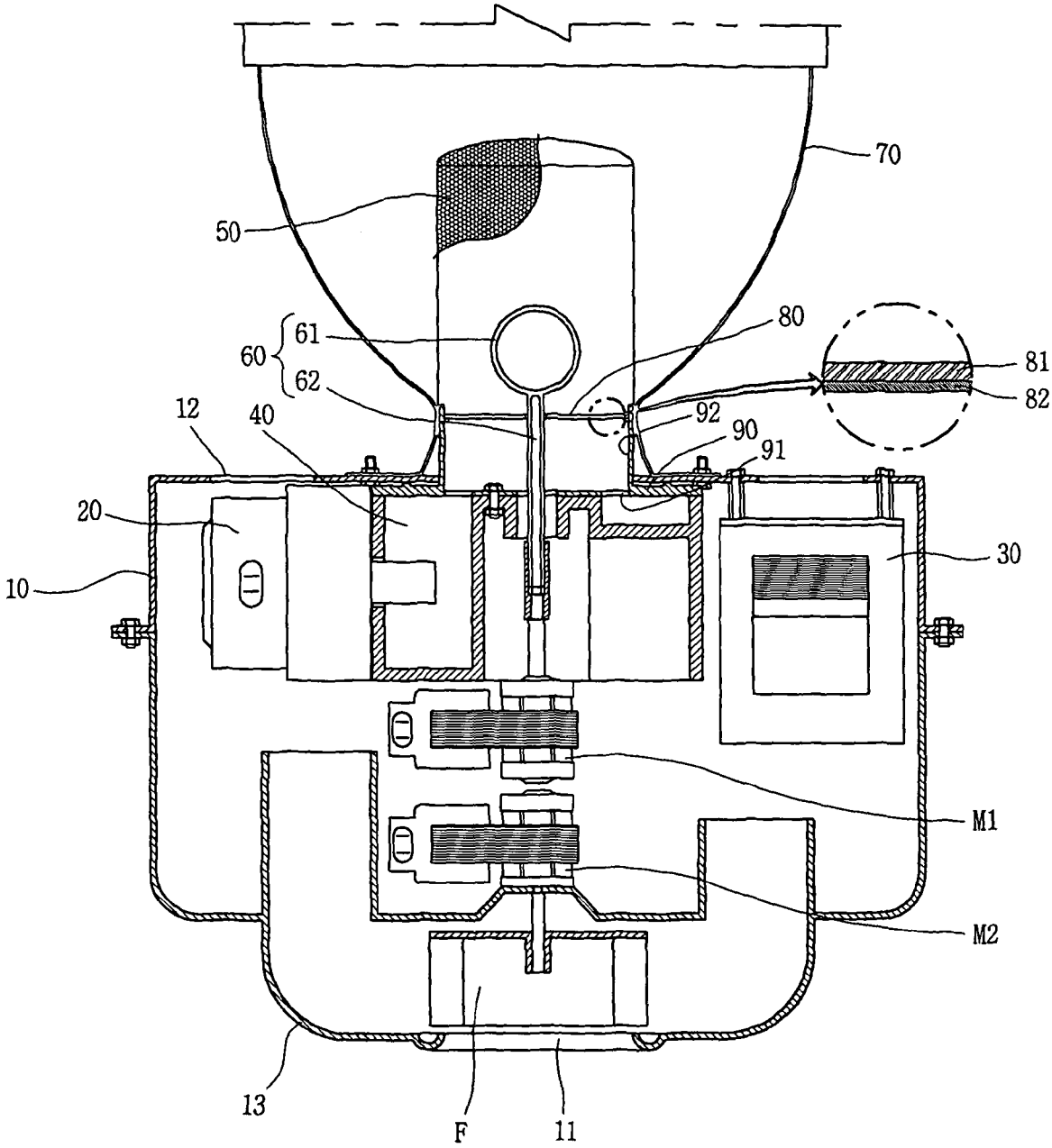
FIG. 1 CONVENTIONAL ART
FIG. 1 is a longitudinal section view showing one example of a plasma lighting system in accordance with the conventional art.
Figure 2:
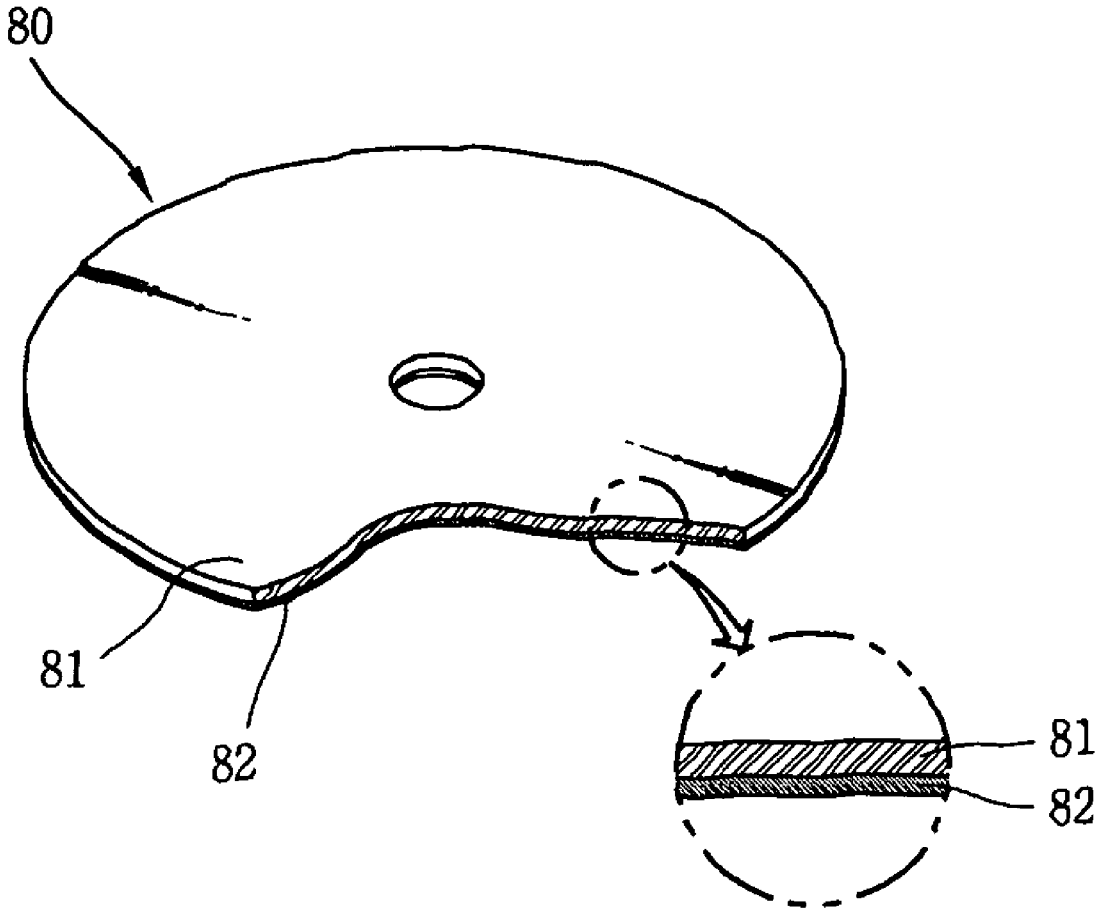
FIG. 2 CONVENTIONAL ART
FIG. 2 is a perspective view showing a dielectric mirror in the plasma lighting system in accordance with the conventional art.
Figure 3:
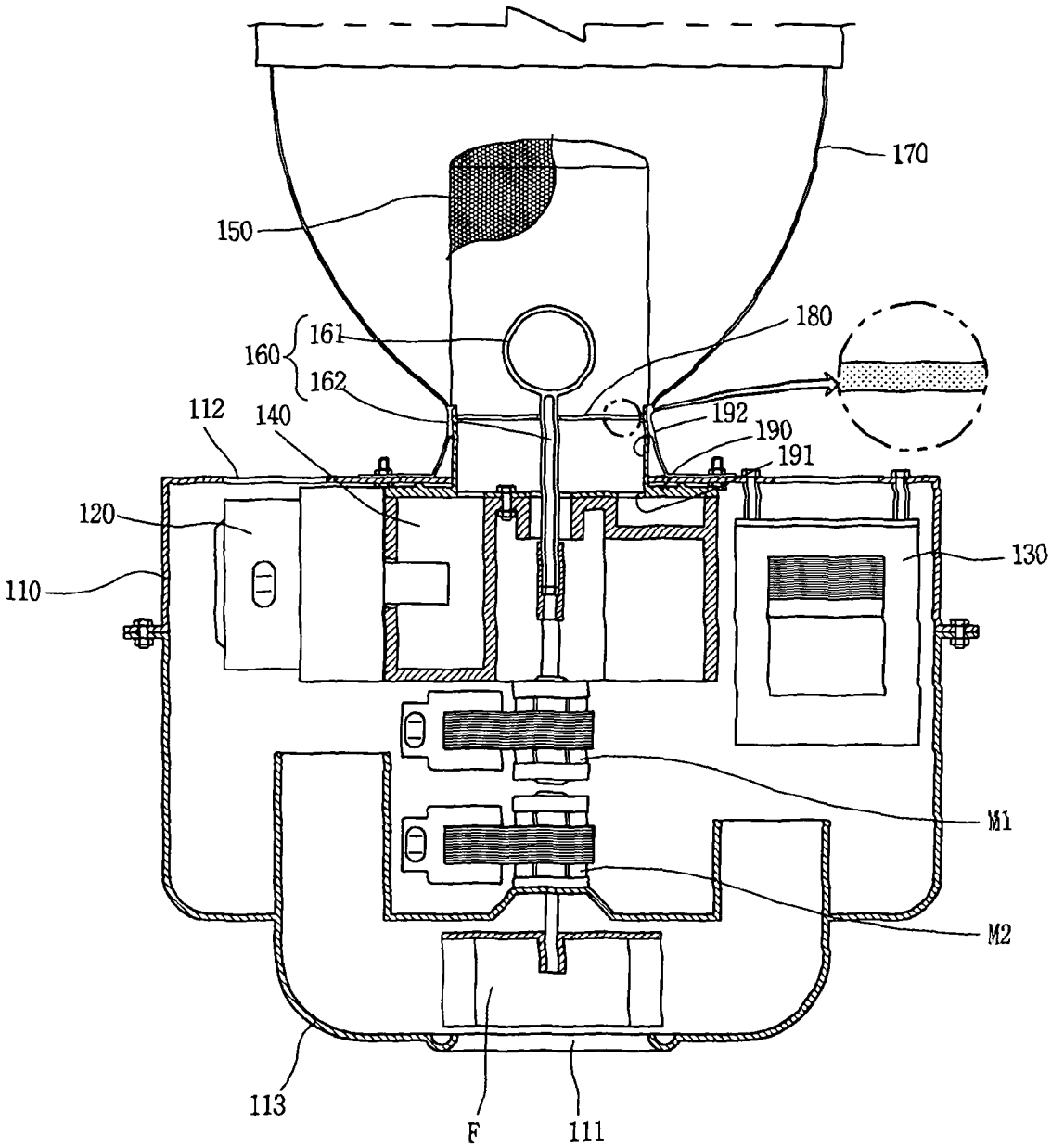
FIG. 3 is a longitudinal section view showing one example of a plasma lighting system according to the present invention.
Figure 4:
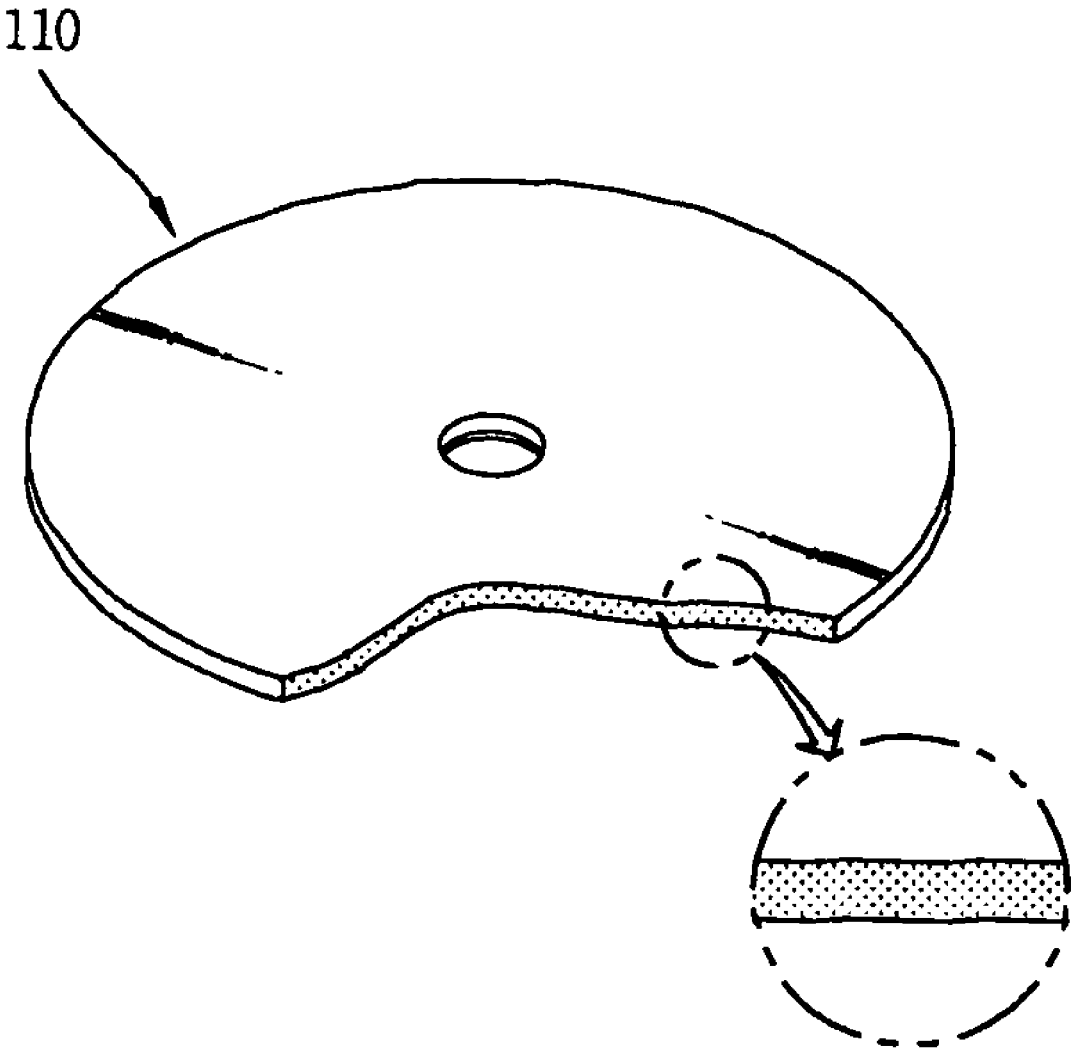
FIG. 4 is a perspective view showing a dielectric mirror in the plasma lighting system according to the present invention.

FIG. 3 is a longitudinal section view showing one example of a plasma lighting system according to the present invention, and FIG. 4 is a perspective view showing a dielectric mirror in the plasma lighting system according to the present invention.

As shown, the plasma lighting system according to the present invention comprises a magnetron 120 mounted in a casing 110 and generating electromagnetic wave, a high voltage generator 130 for supplying alternating current (AC) power to the magnetron 120 by boosting into a high voltage, a wave guide 140 connected to an outlet of the magnetron 120 for transmitting electromagnetic wave generated from the magnetron 120, a resonator 150 connected to an outlet of the wave guide 140 for resonating the electromagnetic wave passing through the wave guide 140, a bulb 160 disposed in the resonator 150 for emitting light by making the discharge materials filled therein into plasma by electromagnetic wave, a reflector 170 containing the resonator 150 therein for forwardly reflecting light generated from the bulb 160, a dielectric mirror 180 mounted in the resonator 150 positioned at a rear side of the bulb 160 for passing electromagnetic wave and reflecting light, and an electromagnetic wave guiding plate 190 covering the outlet of the wave guide 140 and having an electromagnetic wave passing hole 191 for connecting the wave guide 140 and the resonator 150 to each other.

The bulb 160 comprises a light emitting portion 161 having an inner volume and a sphere shape formed of a quartz material, disposed outside the casing 110, and containing a discharge material therein, a discharge catalyst material, etc. therein for emitting light by making the inner materials into plasma; and a supporting portion 162 integrally extending from the light emitting portion 161 and supported in the casing 110.

As shown in FIG. 3, the dielectric mirror 180 has a disc shape so as to be inserted into the cylindrical resonator 150 to be fixed. Preferably, the dielectric mirror 180 is formed of a ceramic material endurable to a high temperature and having a high diffusion reflection ratio for visible rays so as to smoothly reflect light generated form the bulb 160 without a reflection coating layer.

Also, a reflection surface of the dielectric mirror 180 is precisely processed by a polishing method, etc. so that light generated from the bulb 160 can be evenly reflected in a forward direction.

The electromagnetic wave guiding plate 190 is provided with the electromagnetic wave passing hole 191 for guiding electromagnetic wave to the resonator 150 by connecting the wave guide 140 and the resonator 150 to each other at the center thereof. Also, a fixing portion 192 having the electromagnetic wave passing hole 191 for fixing the reflector 170 at an outer circumferential surface thereof and fixing the dielectric mirror 180 thereon is formed at one side of the electromagnetic wave guiding plate 190. The fixing portion 192 has a height not to cover the light emitting portion 161 of the bulb 60.

The same reference numerals are given to the same parts of the present invention as those of the conventional art.

An unexplained reference numeral 111 denotes an air inlet, 112 denotes an air outlet, 113 denotes an air flow path, F denotes a cooling fan, M1 denotes a bulb motor for rotating the bulb, and M2 denotes a fan motor for rotating the cooling fan.

An operation of the plasma lighting system according to the present invention will be explained as follows.

When a driving signal is inputted to the high voltage generator 130 by a controller, the high voltage generator 130 boosts alternating current (AC) power thus to supply it to the magnetron 120. Then, the magnetron 120 is oscillated by the high voltage thus to generate electromagnetic wave having a high frequency. The electromagnetic wave is emitted into the resonator 150 through the wave guide 140, and continuously excites the discharge material and the discharge catalyst material filled in the bulb 160 into a plasma state. As the result, light having a specific emission spectrum is generated, and the light is forwardly reflected by the reflector 170 and the dielectric mirror 180 thus to illuminate a space.

The dielectric mirror 180 is formed of a ceramic material having a high diffusion reflection ratio for visible rays without a reflection coating layer. Accordingly, light generated from the bulb 160 is effectively reflected, and the dielectric mirror 180 is not damaged by heat of a high temperature. As the result, an optical efficiency of the dielectric mirror 180 is not degraded even if it is used for a long time.

The dielectric mirror may not be provided at all. In this case, the resonator positioned at a rear side of the bulb or a surface of the wave guide received in the resonator is partially polished precisely so as to effectively reflect light generated from the bulb.

Figure 5:
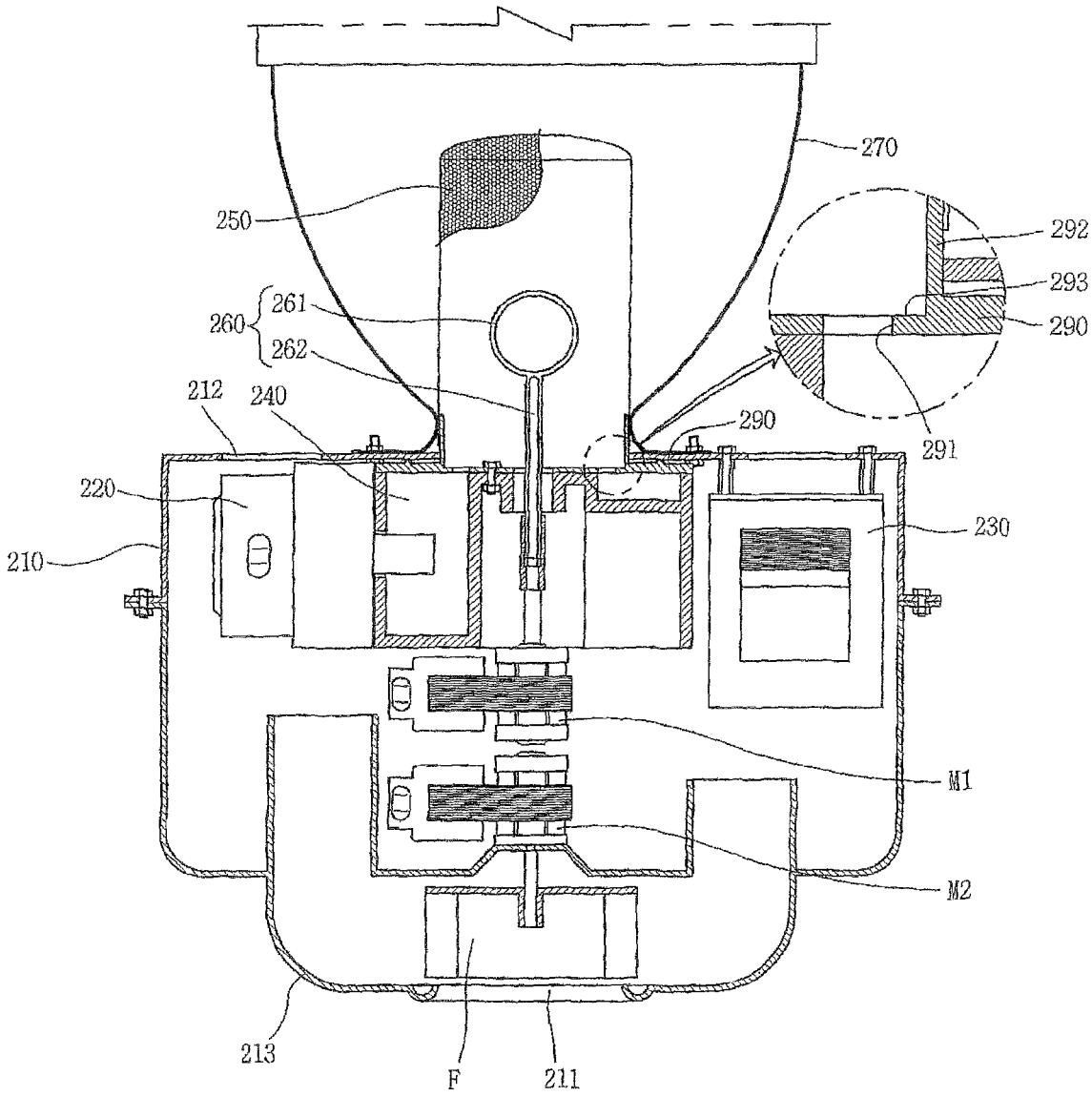
FIG. 5 is a longitudinal section view showing a plasma lighting system according to another embodiment of the present invention.

As shown in FIG. 5, instead of using the dielectric mirror for forwardly reflecting light generated from the bulb 260 in a backward direction, an electromagnetic wave guiding plate 290 is used as a reflection surface thereby to forwardly reflect light generated from the bulb 260 in a backward direction.

The electromagnetic wave guiding plate 290 is provided with an electromagnetic wave passing hole 291 for connecting the wave guide 240 and the resonator 250 to each other at a center thereof. Also, a fixing portion 292 having the electromagnetic wave passing hole 291 and protruding with a certain height so as to fix the reflector 270 at an outer circumferential surface thereof is formed at the electromagnetic wave guiding plate 290.

The electromagnetic wave passing hole 291 can be formed so that an outer circumferential surface thereof can be in contact with an inner circumferential surface of the fixing portion 292. Also, as shown in FIG. 5, the electromagnetic wave passing hole 290 can be formed so that an outer circumferential surface thereof can be further provided with a reflection surface 293 having a certain width at an inner circumferential surface of the fixing portion 292 so as to forwardly guide light reflected to a lower end of the fixing portion 292. As shown in FIG. 5, the reflection surface 293 can be formed to be perpendicular to the fixing portion 292.

Figure 6:
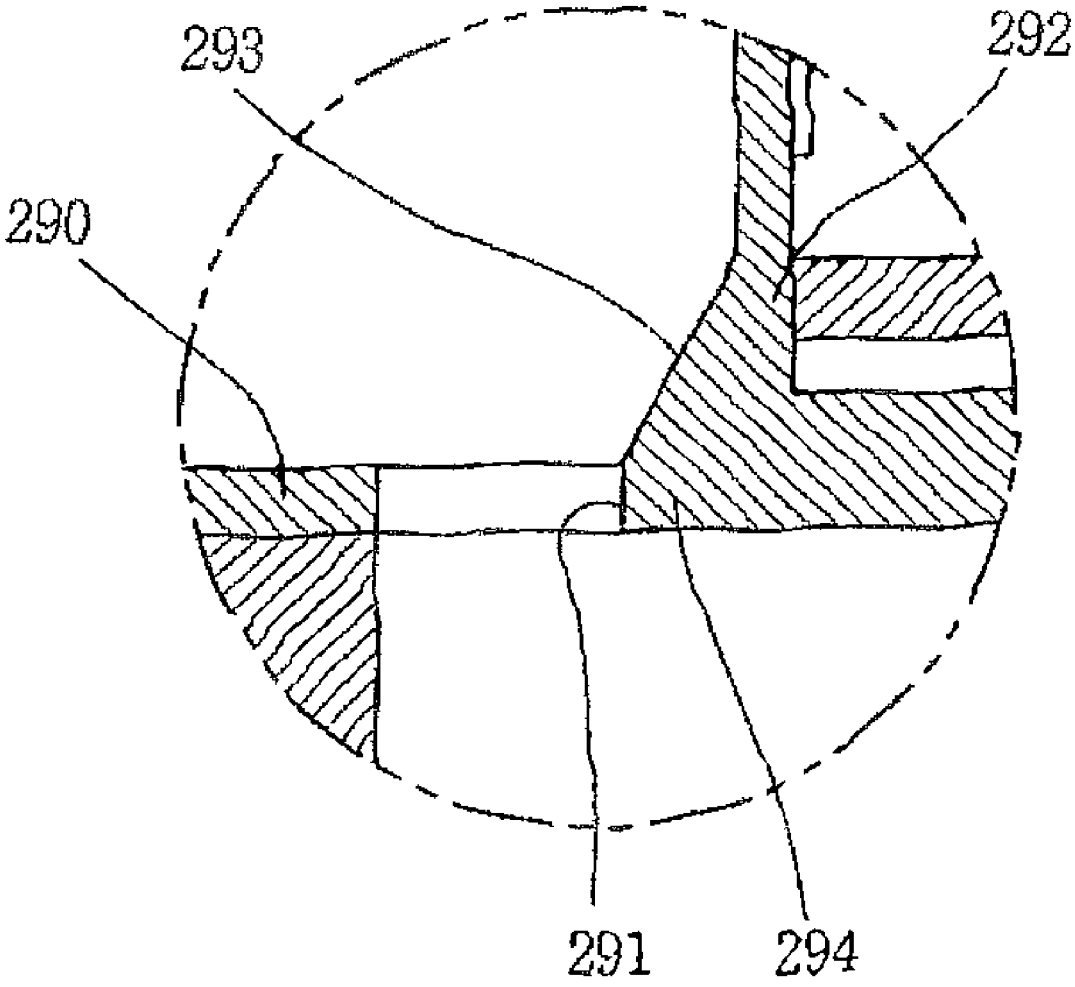
FIG. 6 is a sectional view showing a modification example of a main part of the plasma lighting system according to another embodiment of the present invention.

Also, as shown in FIG. 6, the reflection surface 293 can be formed to be inclined with the fixing protrusion with a certain inclination angle so as to control a reflection angle of light. That is, the electromagnetic wave guiding plate 290 includes a covering portion 294 that covers the outlet of the wave guide 240 and the fixing portion 292 extending from an upper surface of the fixing portion 294 by a predetermined height with a ring shape so as to accommodate the electromagnetic wave passing hole 291 therein, and having the resonator 250 coupled thereto. The reflection surface 293 is integrally formed between an upper surface of the covering portion 294 and an inner circumferential surface of the fixing portion 292 so as to forwardly reflect light backwardly generated from the bulb 260, and the reflection surface 293 is formed with an inclination toward the upper surface of the covering portion 294 from the inner circumferential surface of the fixing portion 292.

An unexplained reference numeral 210 denotes a casing, 211 denotes an air inlet, 212 denotes an air outlet, 213 denotes an air flow path, 220 denotes a magnetron, 230 denotes a high voltage generator, 261 denotes a light emitting portion, 262 denotes a supporting portion, F denotes a cooling fan, M1 denotes a bulb motor, and M2 denotes a fan motor.

As aforementioned, in the present invention, the electromagnetic wave guiding plate is used to in order to forwardly reflect light generated from the bulb in a backward direction instead of the dielectric mirror. Accordingly, a production cost and an assembly cost for the dielectric mirror can be saved. Also, the size of the plasma lighting system can be reduced by lowering the height of the fixing protrusion.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalents of such metes and bounds are therefore intended to be embraced by the appended claims.

What is claimed is:

1. A plasma lighting system, comprising:

a casing;

a magnetron, installed in the casing, to generate electromagnetic waves;

a wave guide, installed in the casing to be connected to the magnetron, for guiding electromagnetic waves generated from the magnetron;

an electromagnetic wave guiding plate coupled to the casing so as to cover an output of the wave guide, and having an electromagnetic wave passing hole on a surface that covers the output of the wave guide;

a resonator coupled to the electromagnetic wave guiding plate so as to communicate with an exit of the wave guide;

a bulb received in the resonator and containing a discharge material therein for emitting light as the discharge material becomes a plasma state by an electric field;

a reflector containing the resonator and the bulb therein for reflecting light generated from the bulb;

wherein the electromagnetic wave guiding plate includes:

a first portion that covers the outlet of the wave guide; and a second portion extending from an upper surface of the first portion by a predetermined height with a ring shape so as to accommodate the electromagnetic wave passing hole therein, and having the resonator coupled thereto, wherein a reflection surface portion for forwardly reflecting light backwardly generated from the bulb is integrally formed between the upper surface of the first portion and an inner circumferential surface of the second portion, and wherein the reflection surface portion is formed with an inclination toward the upper surface of the first portion from the inner circumferential surface of the second portion.

* * * * *